United States Patent [19]

Honkaniemi et al.

[11] Patent Number: 4,491,952

[45] Date of Patent: Jan. 1, 1985

[54] ELECTRIC FURNACE DOME

[75] Inventors: Matti Honkaniemi, Tornio; Martti Jankkila, Kiviranta; Aimo Nurminen; Matias Virta, both of Kokkokangas; Veikko Iisakka, Tornio; Helge Krogerus, Pori; Heikki Tuovinen, Ulvila; Tarmo Mäntymäki, Merstola; Erkki Lajunen, Nakkila, all of Finland

[73] Assignee: Outokumpu Oy, Helsinki, Finland

[21] Appl. No.: 463,862

[22] PCT Filed: Jun. 3, 1982

[86] PCT No.: PCT/FI82/00022

§ 371 Date: Jan. 24, 1983

§ 102(e) Date: Jan. 24, 1983

[87] PCT Pub. No.: WO82/04306

PCT Pub. Date: Dec. 9, 1982

[30] Foreign Application Priority Data

Jun. 5, 1981 [FI] Finland ..... 811763

[51] Int. Cl.[3] ..... F27D 1/12

[52] U.S. Cl. ..... 373/74

[58] Field of Search ..... 373/74, 73, 76, 9; 432/237; 266/280; 110/331, 335

[56] References Cited

U.S. PATENT DOCUMENTS

| | | | |
|---|---|---|---|
| 2,222,004 | 11/1940 | Smith . | |
| 2,718,537 | 9/1955 | Basler | 373/74 X |
| 2,752,410 | 6/1956 | Olsson . | |
| 2,871,278 | 1/1959 | Sandvold . | |
| 3,129,274 | 4/1964 | Lindblom et al. . | |
| 3,375,317 | 3/1968 | Hansen et al. . | |
| 3,429,973 | 2/1969 | Carter et al. | 373/74 |
| 4,197,422 | 4/1980 | Fuchs et al. | 373/74 |
| 4,273,949 | 6/1981 | Fischer et al. | 373/74 |

FOREIGN PATENT DOCUMENTS

| | | |
|---|---|---|
| 1065540 | 9/1959 | Fed. Rep. of Germany . |
| 1077734 | 11/1954 | France . |
| 898532 | 6/1962 | United Kingdom . |

*Primary Examiner*—Roy N. Envall, Jr.

*Attorney, Agent, or Firm*—Pennie & Edmonds

[57] ABSTRACT

Electric furnace dome that is made especially of ceramic material and which has the necessary openings for at least electrodes and material feed, at which time the dome's center (2) inside of the tube systems (3) is cooled at least around the openings with the aid of spiral tube systems (5,7,8,9) whose tube systems (3,5,7,8,9) form a part of the dome's support system.

6 Claims, 2 Drawing Figures

ELECTRIC FURNACE DOME

This invention relates to an electric furnace dome that is hermetic and made of ceramic material and that is cooled at its center and supported with the aid of external tube systems to improve durability.

The simplest and most inexpensive dome construction is one that is made of bricks or cast from mass, the dome being in reality dome-shaped, in other words the surface is outwards in the shape of a round ball. If the dome is built of ceramic mass, its structure is generally quite weak, which is the reason why it must be supported at those points where there are for example openings. Not even supporting however always helps, but the resulting construction is still weak at least under situations of malfunction. Fully supported brick domes that have a planar surface area also used. Such structures are generally very expensive and difficult to repair and service. Externally cooled domes have become known as a third alternative, as for example the box beam construction that has become known from the Finnish patent application No. 783705. A drawback of this dome also is its expensiveness, as well as the energy losses caused by great amounts of cooling water and the danger of explosion in the case of leakage, electrode breakage or other such inconvenience to production.

The purpose of this invention is to avoid the drawbacks of domes in accordance with technical level and achieve an electric furnace dome whose construction expenses as well as costs of using are moderate and which is hermetic and endures use.

The characteristical features of the invention are given in the accompanying patent claims.

Figure 1:
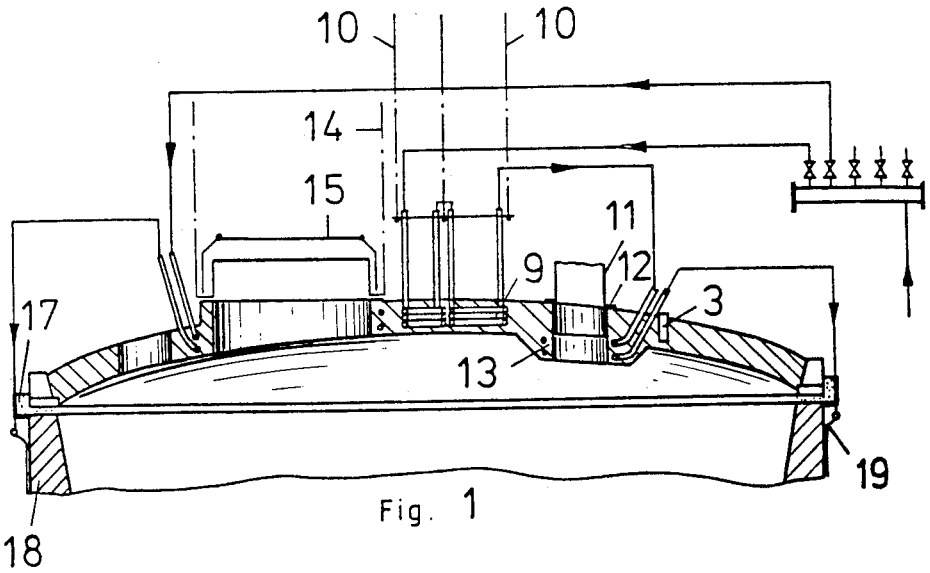
Figure 2:
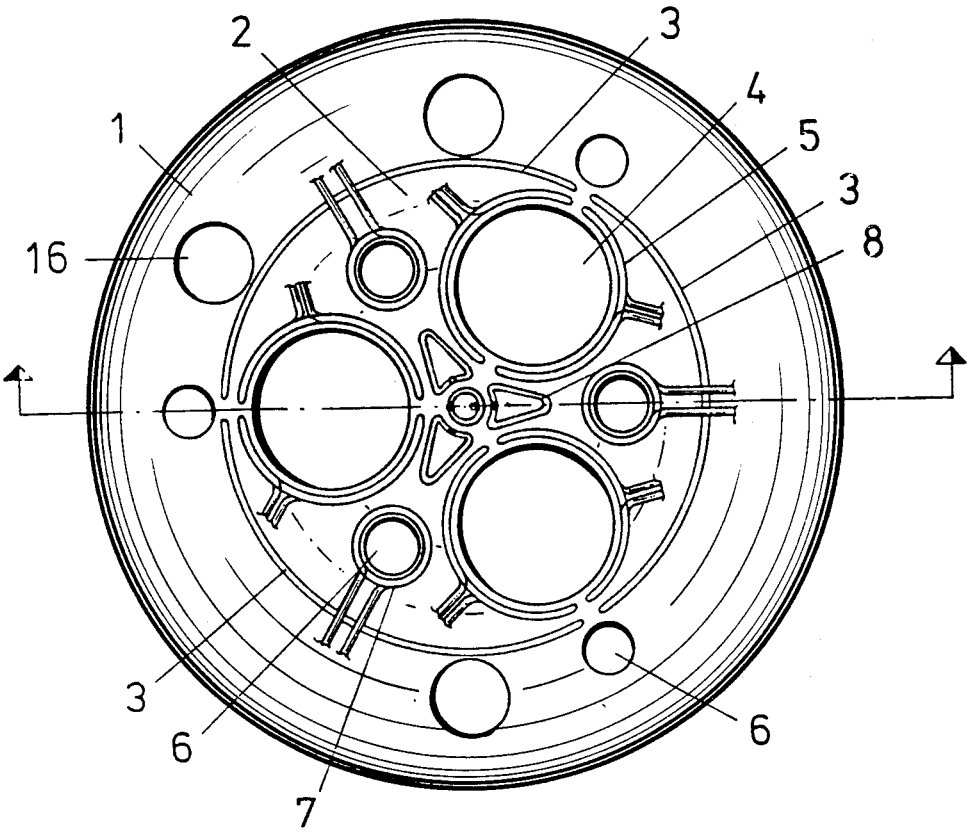

The invention is described in more detail in the following by referring to the accompanying drawings of which FIG. 1 illustrates the side view along the cutline in FIG. 2 of an electric furnace dome in accordance with the invention, FIG. 2 illustrates an electric furnace dome in accordance with the invention viewed from above.

An electric furnace dome in accordance with the invention is made of ceramic material (mass and/or brick) and is constructed so that the dome's stationary edge 1 is separated from the easily repairable or changeable center 2 by water-cooled tube systems 3 that are supported from outside of the dome. Further the dome's center 2 which is under great strain is watercooled by spiral tube systems that are inside of the dome structure. In the figures the spiral tube systems in the center of the dome that are around the openings 4 for the electrodes are indicated by the number 5, the spiral tube systems around the material feed openings 6, some of which are in the center of the dome and thus watercooled and some on the edge of the dome, are indicated by the number 7, and the spiral tube systems that are directly in the center of the dome are indicated by the numbers 8 and 9. The spiral tube systems are at the same time a part of the dome's watercooled support system, because the spiral tube systems are supported at both of their ends by supporting rods 10 from outside of the dome, as FIG. 1 illustrates for example for the spiral tube system 9.

The input pipes 11 that are fastened to the openings 6 for raw material feed are equipped with ceramic lining and are tightened to the corresponding part 2 and 1 on the dome with a thin insulating layer 12 that consists of ceramic wool and/or fibre and that due to watercooling endures the electric furnace's temperatures well. The effect of the watercooling reaches however beyond the insulating layer which to a certain extent increases the dome's tenacity to endure practical circumstances in the possible cases of malfunction caused by for example the overheating of the furnace.

Further the raw material's input pipes 11 go through the dome and that section 13 that is on the inside of the furnace is a fixed part of the dome's cooling system and thus increases the dome's hermetic sealing because the input pipes are watercooled at that part of the dome and on the inside of the furnace by a spiral tube system 7 that is supported from outside of the dome.

The openings 4 for electrodes in an electric furnace dome in accordance with the invention are watercooled and hermetically sealed in two stages. Water spiral tube system 5 that is supported from outside of the dome is mounted in the dome center's 2 refractory masonry, the water spiral tube system being thus at the same time a part of the dome's watercooled support system around the electrode opening. Spiral tube system advantageously improves the durability of the area around the electrode opening which to a certain extent increases the dome's hermetic sealing. Further a water seal's casing 15 which is made of refractory steel plate and is equipped with external support rods 14 is above the hole for the electrode, the water in the seal being separate or a part of the water circulating through the spiral tube systems. The water seal aids in the dome's hermetic sealing especially between the current contact pack and the dome's center 2.

In the figures the number 16 indicates an opening through which vapours and gases are removed from the furnace. Number 17 on the other hand indicates a watercooled sand seal which aids in achieving sealing between the dome's edge 1 and the pot 18 and number 19 indicates the pot's external watercooling system where the cooling water in the spiral tube systems is led, as is shown by the arrow in FIG. 1.

The heat loss of an electric furnace dome in accordance with the invention is moderate because of the selection of favourable material. For processtechnical reasons ceramic mass or refractory bricks may be used as the construction material for the whole dome. The dome may also be constructed so that the edge 1 and the center 2 of the dome are made of different materials, from mass or bricks. However in all applications, tube systems 3 are used to separate the dome's edge 1 from the center 2, at which time the dome's edge 1 is stationary and if necessary the center 2 may be advantageously repaired or changed in possible cases of malfunction.

The acquisition price of the dome construction that is the object of the invention is also moderate on account of inexpensive construction materials. As a result of external supports it also lasts sufficiently long enough and requires little service and repair. Further the tube systems 3 separating the dome's edge 1 and the center 2 make the placement and operating of devices connected to the dome easier as well as servicing and repairing the dome.

In other words the principle of the dome construction in accordance with the invention is to make as good and profitable use as possible of all of the tenacity, insulatory, refractory, and other such characteristics of the refractory material as well as the advantages of external support and watercooling.

This is achieved by choosing the refractory ceramic material and masonry construction so that the dome is in principle under normal conditions self-supporting and extra strains as well as deficiencies in material and construction are taken care of by external support as well as by watercooling at the most critical points, such as the electrodes and input pipes and at the center of the furnace. The purpose of the watercooling is to protect the support systems that are constructed in the form of tube spirals and are at the critical points of the dome and of the openings as well as to maintain the temperature of the ceramic material at moderate temperatures as far as operating conditions are concerned without however unnecessarily cooling the molten charge.

What is claimed is:

1. In an electric furnace dome having top and bottom surfaces, and having at least one opening for an electrode, the improvement comprising (a) a water-carrying spiral tube system embedded between said surfaces for water-cooling the dome and centered around said electrode opening, and (b) means for supplying cooling water to said spiral tube system and for supporting the dome, said means including a portion of said spiral tube system that extends upwardly and away from said top surface of the dome.

2. In an electric furnace dome having top and bottom surfaces and respective openings at least for one electrode, for the insertion of raw material, and for the exhaust of gases, and having a central portion and an outer portion, said electrode opening being in said central portion, the improvement comprising (a) water-carrying spiral tube systems embedded between said surfaces for water-cooling the dome, located only in said central portion, and at least one spiral tube system being centered around each opening in said central portion; and (b) means for supplying cooling water to said spiral tube systems and for supporting the dome, said means including a portion of each of said spiral tube systems that extends upwardly and away from said top surface of the dome.

3. An electric furnace dome as in claim 2, wherein said dome is made of ceramic material.

4. An electric furnace dome as in claim 2, further comprising a second water-carrying tube system embedded between said surfaces and surrounding said central portion of the dome, for further water-cooling the dome.

5. An electric furnace dome as in claim 4, wherein said dome and said second water-carrying tube system are substantially circular.

6. An electric furnace dome as in claim 2, further comprising at least one water seal mounted on said central portion of said dome for sealing and water-cooling said electrode opening, and wherein said means for supplying cooling water are connected to said water seal so as to circulate the same water sequentially through said seal and at least one of said tube systems.

* * * * *